US005520149A

United States Patent [19]

Kang

[11] Patent Number: 5,520,149

[45] Date of Patent: May 28, 1996

[54] SYSTEM FOR COMPENSATING AN IDLE OPERATION AND RELATED CONTROL METHOD

[75] Inventor: Daejin Kang, Suwon, Rep. of Korea

[73] Assignee: Hyundai Motor Company, Seoul, Rep. of Korea

[21] Appl. No.: 350,905

[22] Filed: Dec. 7, 1994

[30] Foreign Application Priority Data

Dec. 7, 1993 [KR] Rep. of Korea ..... 93-26696

[51] Int. Cl.[6] ..... F02M 3/00

[52] U.S. Cl. ..... 123/339.1

[58] Field of Search ..... 123/339, 339.1, 123/339.14, 339.16, 339.17, 339.18

[56] References Cited

U.S. PATENT DOCUMENTS

| | | | |
|---|---|---|---|
| 4,441,471 | 4/1984 | Kratt et al. | 123/339 |
| 4,554,899 | 11/1985 | Engel et al. | 123/357 |
| 4,708,110 | 11/1987 | Weitschorke et al. | 123/339 |
| 4,777,918 | 10/1988 | Yasuoka | 123/339 |
| 4,909,213 | 3/1990 | Mezger et al. | 123/339 |
| 5,003,947 | 4/1991 | Lemberger | 123/339 |

*Primary Examiner*—Raymond A. Nelli
*Attorney, Agent, or Firm*—Finnegan, Henderson, Farabow, Garrett & Dunner

[57] ABSTRACT

A system for compensating an idle operation and related control method capable of executing a smooth idle operation includes means for compensating an amount of air supplied to an intake manifold according to changes in electrical loads when peripheral electric devices of high loads are activated during the idle operation. The system includes an idle sensor, a peripheral electric device operation sensor, a power state sensor, a filtered power state sensor, an electric control unit, and an idle controller.

4 Claims, 3 Drawing Sheets

SYSTEM FOR COMPENSATING AN IDLE OPERATION AND RELATED CONTROL METHOD

BACKGROUND OF THE INVENTION

1. Field of The Invention

The present invention relates generally to a system for compensating an idle operation and related control method, and more particularly, to a system for achieving a smooth idle operation by compensating for an amount of air supplied to an intake manifold in accordance with changes in electrical loads when peripheral electric device of high loads are activated during the idle operation.

2. Description of Related Art

Generally, a driver starts an automotive vehicle and lets it idle, i.e., a warm-up operation, for a predetermined time, to ensure that the automotive vehicle will run smoothly when the driver accelerates the engine to run the automotive vehicle.

During the idle operation, a control unit senses the operating state of the automotive vehicle or engine using various sensors. The control unit supplies air corresponding to an idle operation state to each cylinder of the engine to achieve an optimal idle operation. As a result, during the idle operation, the engine operates smoothly to improve fuel ratio.

However, when the driver activates electrical devices, such as an air conditioner or head lights, and the engine is not idled-up by pressing on the accelerator pedal, the engine becomes loaded and its rotational frequency (rpm) is sharply reduced.

Conventionally, to compensate for such fluctuation in the rotational frequency and to provide a smooth idle operation, a normally injected fuel amount or spark time is increased or decreased corresponding to an amount of indraft air. Accordingly, the engine may operate normally.

However, when a predetermined, normally injected fuel amount or spark time is compensated and the operation of the engine is changed, as described above, a problem arises in that a rapid compensation is not possible. This is because the amount of air does not change at the same rate or time as the increase in fuel amount.

In addition, fuel is wasted since a large amount of fuel is injected relative to the amount of indraft air at a sudden instant, and at the same time, a large amount of pollutants, due to imperfect combustion, are exhausted.

SUMMARY OF THE INVENTION

Accordingly, the present invention is directed to a system and related control method for compensating an idle operation of an automotive vehicle that substantially obviates one or more of the problems due to limitations and disadvantage of the prior art.

An advantage of the present invention is the provision of a system for compensating an idle operation and related control method that overcomes the problems and disadvantages of the conventional devices.

The features and advantages of the invention will be set forth in the description which follows, and in part will be apparent from the description, or may be learned by practice of the invention. The objectives and other advantages of the invention will be realized and attained by the apparatus and method particularly pointed out in the written description and claims hereof as well as the appended drawings.

To achieve this and other objects and in accordance with the purpose of the invention, as embodied and broadly described herein, a system for compensating an idle operation includes first means for sensing whether and automotive vehicle is idling to produce a signal corresponding to an operating state; second means for sensing the operation state of a peripheral electrical device to produce a signal corresponding to the operation state; third means for sensing the power ON/OFF state to produce a signal corresponding to the operation state; fourth means for sensing a filtered power state to produce a signal corresponding to the operation state; fifth means for comparing the change in the amount of power |BATi–BATFi| with an established value A, after calculating the change in the amount of power |BATi–BATFi| when it is determined that the second means is operated during an idle operation according to a signal applied from the first means and second means, for calculating a compensation amount or value COBAT of the indraft air amount after establishing a compensation variable Bx according to the state of the power signal BATi and the filtered power signal BATFi when the change in the amount of power |BATi–BATFi| is greater than or equal to the established value A, and for producing a signal for increasing the amount of the indraft air when idling as much as the compensation value COBAT for the calculated amount of the indraft air to an intake maniflod; and sixth means connected to said fifth means and for compensating rotational frequency of an engine reduced when said second means is operated during an idle operation of the engine by changing an open degree of an idle speed actuator according to a signal applied from said fifth means.

According to another aspect of the present invention, a method for controlling a system for compensating an idle operation includes the steps of determining whether an engine is idling according to a signal applied from a first means; determining whether a peripheral electrical device is operated according to a signal applied from a second means when the engine is idling; calculating a change in the amount of power |BATi– BATFi| according to a signal applied from third and fourth means when the peripheral electric device is operated and comparing the change in the amount of power |BATi–BATFi| with an established value A; calculating the compensation value COBAT for the indraft air amount after establishing a value of the compensation variable Bx according to the state of the power signal BATi and the filtered power signal BATFi when the change in the amount of power |BATi–BATFi| is greater than or equal to the established value A; increasing the amount of the indraft air when idling according to the calculated compensation value COBAT for the indraft air amount and comparing the change in the amount of power |BATi–BATFi| with the established value A; and reducing the compensation value COBAT for the indraft air amount at every second established time after compensating the indraft air amount as much as the established compensation value COBAT for the indraft air amount during the first established time when the change amount |BATi–BATFi| of power is less than the established value A.

It is to be understood that both the foregoing general description and the following detailed description are exemplary and explanatory and are intended to provide further explanation of the invention as claimed.

The accompanying drawings, which are incorporated in and constitute a part of this specification, illustrate exemplary embodiments of the invention and together with the description, serve to explain the principles of the invention.

DETAIL DESCRIPTION OF THE PREFERRED EMBODIMENTS

Reference will now be made in detail to the preferred embodiments of the invention, examples of which are illustrated in the accompanying drawings.

Figure 1:
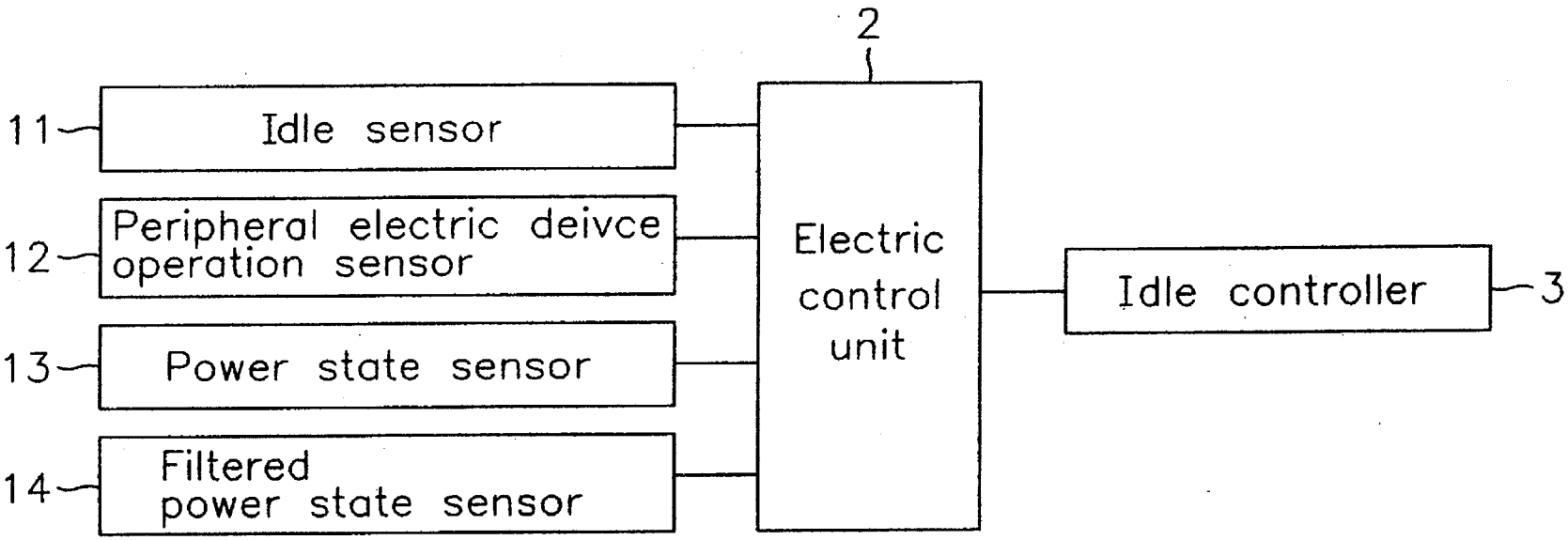
FIG. 1 is a block diagram of a system for compensating an idle operation in accordance with an embodiment of the present invention.

Referring to FIG. 1, a system for compensating an idle operation includes an idle sensor 11 for sensing whether an automotive vehicle is idling to produce a signal corresponding to its operating state. A peripheral electrical device operation sensor 12 senses the operating state of each peripheral electrical device in the automotive vehicle to produce a signal corresponding to its operating state. A power state sensor 13 senses a power ON/OFF state to produce a signal corresponding to its operating state, and a filtered power state sensor 14 senses the filtered power state to produce a signal corresponding to its operating state. An electric control unit 2 is connected to the sensors 11, 12, 13 and 14 and determines the operating state of the engine according to signals applied from the sensors 11, 12, 13 and 14 to produce a control signal for controlling an idle operation. An idle controller 3 is connected to the electric control unit 2 and controls an indraft air amount according to the control signal applied from the electric control unit 2.

Figure 2A:
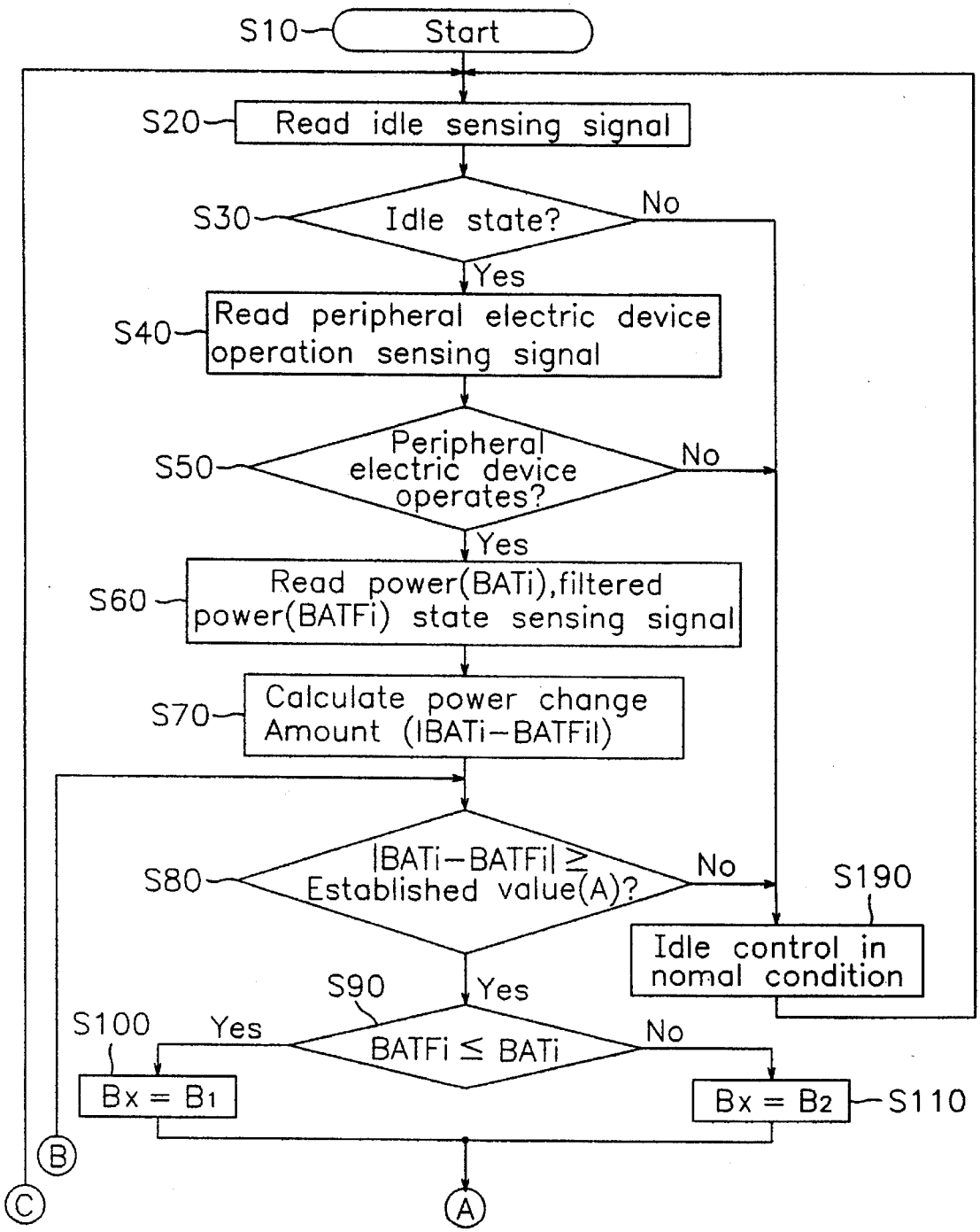
FIGS. 2A and 2B constitute a continuous flowchart of the steps in a method for controlling the system for compensating an idle operation in the embodiment of the present invention.
Figure 2B:
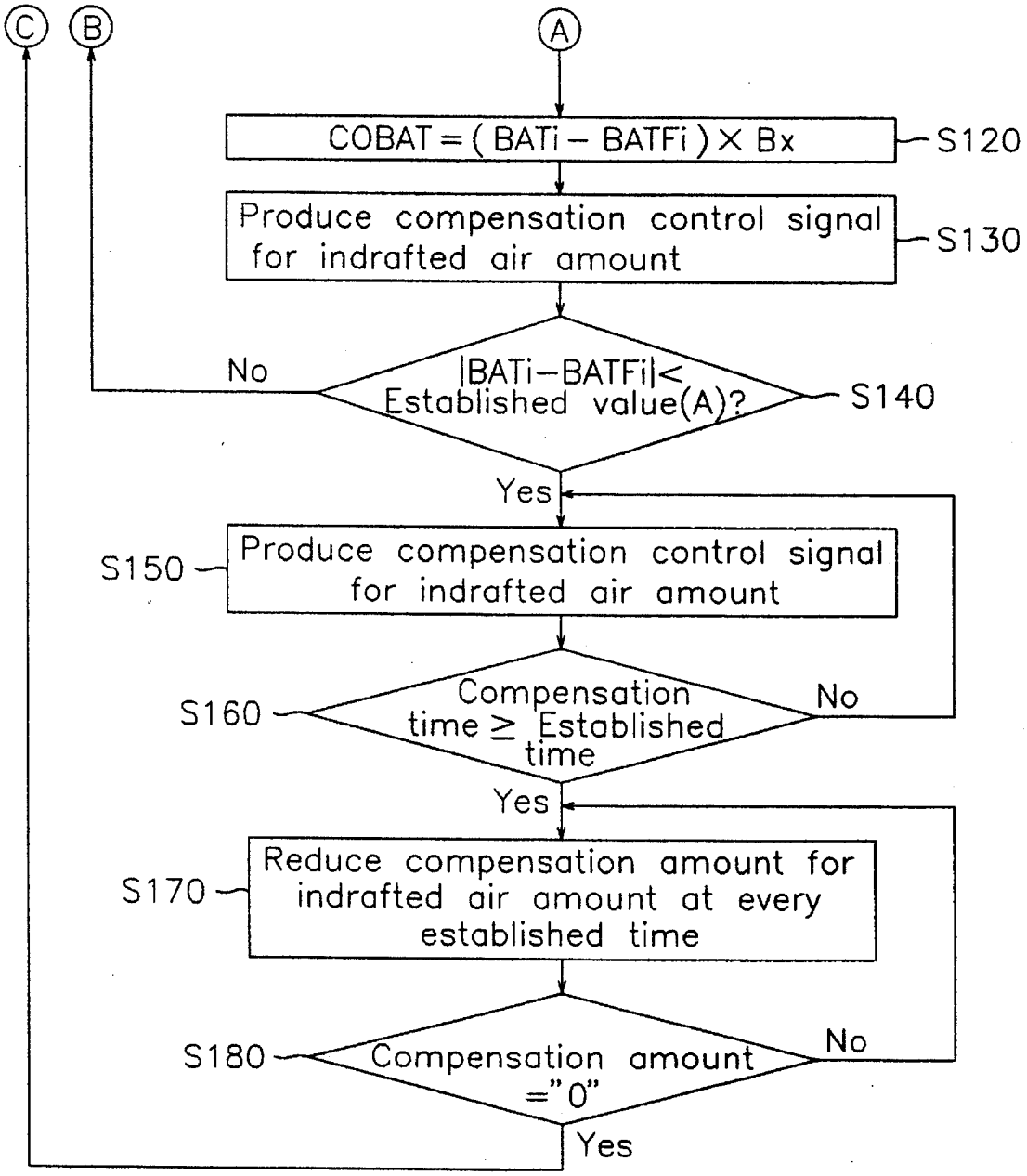

The operation of the system according to the embodiment of the present invention will be explained according to the flowchart of FIGS. 2A and 2B.

A power applied to the system activates the electric control unit 2 (S10). Then, the electric control unit 2 reads a signal applied from the idle sensor 11 (S20) and determines whether the engine is idling (S30). If the engine is not idling and operates normally, the electrical control unit 2 controls the engine (S190), continually reads the signal applied from the idle sensor 11 (S20), and determines the operating state of the engine. If the engine is idling and the accelerator pedal is not pressed, according to the signal applied from the idle sensor 11, the electric control unit 2 reads the signal applied from the peripheral electric device operation sensor 12 to determine the operating state of each peripheral electric device of high loads on the automotive vehicle, such as an air-conditioner or head lights in the automotive vehicle (S40). Then, the electric control unit 2 determines the operating state of each peripheral electric device according to the signal applied from the peripheral electric device operation sensor 12 (S50).

The electric control unit 2 reads the signal applied from the peripheral electric device operation sensor 12 and determines that one or more peripheral electric devices have been activated by the driver. Also, the electric control unit 2 determines that a signal corresponding to the operation of the peripheral electric device has been applied and executes an operation to compensate for a decrease in the rotational frequency of the engine, due to the operation of the peripheral electric device during the idle operation.

However, when the electric control unit 2 determines that no peripheral electric device is activated after reading the signal applied from the peripheral electric device operation sensor 12, the electric control unit 2 controls the idle operation in a normal manner (S190). The electric control unit 2 also continually reads the signal applied from the idle sensor 11 (S20) and determines the operating state of the engine.

When the electric control unit 2 determines that a peripheral electric device is activated after reading the signal applied from the peripheral electric device operation sensor 12, the electric control unit 2 reads signals applied from the power state sensor 13 and the filtered power state sensor 14 (S60).

Power BATFi determined by the filtered power state sensor 14 is used to determine the state of power for supplying the necessary voltage to each peripheral electric device after removing noise included in power BATi necessary for the operation of the automotive vehicle. At this time, the electric control unit 2 determines how much power is consumed by the operation of the peripheral electric device. The electric control unit 2 calculates a difference between the power BATi and the filtered power BATFi (S70) to determine the change in the amount of power, which varies according to the operation of the peripheral electric device.

Next, the electric control unit 2 determines the change in the amount of power by determining whether an absolute value |BATi–BATFi| of the calculated change in the amount of power is greater than or equal to an established value A (S80). If the absolute value |BATi–BATFi| is less than the established value A, the electric control unit 2 determines that the change in the amount of power cause by the operation of the peripheral electric device is not significant enough to activate the compensation operations during idling. Hence, the electric control unit 2 controls the idle operation of the engine in a normal manner (S190), continually reads the signal applied from the idle sensor 11 (S20), and determines the operating state of the engine.

However, if the absolute value |BATi–BATFi| is greater than or equal to the established value A, the electric control unit 2 compares the values of the power signal BATi and filtered power signal BATFi (S90). The comparison is used to determine the state of the filtered power signal BATFi and generate a compensation variable Bx to compensate for the amount of indraft air.

If the value of the power signal BATi is greater than or equal to the value of the filtered power signal BATFi, the electric control unit 2 sets the compensation variable Bx to a first set value B1 (S100). But, if the value of the power signal BATi is less than the value of the filtered power signal BATFi, the electric control unit 2 sets the compensation variable Bx to a second set value B2 (S110). The first and second set values B1 and B2 are data which are experimentally obtained according to the power state and are stored in an internal memory (not shown) in the electric control unit 2.

When the corresponding compensation variable Bx is set according to the state of each power signal BATi and BATFi as described above, the electric control unit 2 calculates a compensation value COBAT for the indraft air according to the following relation (1) using the set compensation variable Bx (S120).

$$COBAT=(BATi-BATFI)\times(Bx) \quad (1)$$

where COBAT is the compensation value for the indraft air amount, BATi is the value of the power signal, BATFi is the value of the filtered power signal, and Bx is the compensation variable. When the compensation value COBAT for the indraft air amount is calculated according to relation (1), the electric control unit 2 produces a signal to the idle controller 3 which controls an opening of an idle speed actuator to increase the amount of indraft air according to the calculated compensation value (S130).

Thus, when the rotational frequency of the engine is sharply reduced by an operation of a peripheral electric device having a high loading affect on the automotive vehicle during idling, the engine control unit 2 controls the amount of indraft air (as in the above) and changes the amount of fuel injected to a corresponding cylinder of the engine according to the amount of the indraft air. Accordingly, the electric control unit 2 compensates for the decrease in the rotational frequency of the engine.

Subsequently, the electric control unit 2 determines whether the absolute value |BATi–BATFi| is within the set range or the established value A after compensating for the decrease in the rotational frequency of the engine by changing the indraft air amount (S140). If the absolute value |BATi–BATFi| is greater than the established value A, the electric control unit 2 determines that the rotational frequency of the engine according to the compensated indraft air amount is beyond the set range or the established value A. At this time, the electric control unit 2 returns to step 80 to make a more accurate compensation according to the operating state of the automotive vehicle, and determines whether the change in the amount of power |BATi–BATFi| is greater than or equal to the established value A.

However, when the change in the amount of power |BATi– BATFi| becomes less than the established value A due to an increase in the rotational frequency of the engine from the compensation of the air amount, the electric control unit 2 controls the opening of the idle speed actuator in the idle controller 3. The electric control unit 2 controls the opening by producing a signal to the actuator of the idle speed actuator, such that the air can flow as much as the established compensation value COBAT through the idle speed actuator in the idle controller 3 during a first established or predetermined time (S150). The control unit 2 repeatedly returns to step 150 until the compensation time is greater than or equal to the first established time (S160). After compensating for the indraft air amount as much as the compensation value COBAT for the air during the first set time, the electric control unit 2 reduces the compensation value COBAT for the air at every second established or predetermined time to adjust the indraft air amount (S170).

As described above, slowly reducing the compensation value for the indraft air amount overcomes problems arising from a sharp or sudden change in the operating state of the engine. When the indraft air amount is reduced at every second predetermined time and the compensation value COBAT for the indraft air amount becomes "0" (S180), the electric control unit 2 determines that the rotational frequency of the engine reduced from operating the peripheral electric device having a high loading affect on the automotive vehicle has been compensated completely. Thus, the engine operates in a normal speed and continually monitors the operation state of the engine (S30) by reading the signal applied from the idle sensor 11 (S30).

However, when the indraft air amount does not become "0", the electric control unit 2 continually reduces the compensation value COBAT for the indraft air amount at every second predetermined time (S170).

As described above, the present invention has an advantage in that a rapid compensation is possible by compensating the indraft air amount corresponding to the change in the amount of power reduced from an operation of a peripheral electric device having a high loading affect on the engine during the idle operation of the engine.

The present invention has another advantage in that the engine operates at a fixed rotational frequency during engine idling since any reduction in the rotational frequency of the engine due to a peripheral electric device is compensated rapidly by increasing the indraft air amount.

It will be apparent to those skilled in the art that various modifications and variations can be made in the system and method for compensating an idle operation of the present invention without departing from the spirit or scope of the invention. Thus, it is intended that the present invention cover the modifications and variations of this invention provided they come within the scope of the appended claims and their equivalents.

What is claimed is:

1. A system for controlling the idle-speed operation of an automotive vehicle having an internal combustion engine, a peripheral electrical device and an idle speed actuator, comprising:

a first means for sensing whether said engine is in an idling state and for producing a first signal representative of said idling state;

a second means for sensing an operating state of said peripheral electrical device and for producing a second signal representative of said operating state;

a third means for sensing a power level of said engine and for producing a third signal (BATi) representative of said power level;

a fourth means for sensing a filtered power state of said engine power level and for producing a fourth signal (BATFi) representative of said filtered power state; and a microprocessor means coupled to said third and fourth means and functioning to:

(a) calculate a change in an amount of power between said third signal and said fourth signal, (b) calculate an absolute value of a difference between the third signal and the fourth signal, (c) calculate the change in an amount of power in response to said first and second signals applied from said first and second means, respectively, (d) compare said absolute value of said difference to a first preset value, (e) calculate a compensation value for compensating for an intake air amount when said absolute value of said difference is greater than or equal to said first preset value, (f) produce a fifth signal for increasing said intake air amount when idling is occurring in accordance with said compensation value for a calculated intake air amount, (g) compensate for a decrease in a rotational frequency of said engine when said second means is operated during an idle state of said engine, and (h) applying said fifth signal to an idle speed actuator to accomplish said compensation for said decrease in rotational frequency of said engine.

2. The system for controlling the idle-speed operation of an automotive vehicle according to claim 1, wherein said microprocessor means further functions to:

(i) reduce the compensation value for the intake air amount at predetermined periods after increasing the intake air amount in accordance with the compensation value during a first time period when the absolute value of said difference is less than the first preset value, and (j) calculating the compensation value for the intake air amount according to the third signal and the fourth signal when the absolute value of said difference is greater than or equal to the first preset value.

3. The system for controlling the idle-speed operation of an automotive vehicle according to claim 1, wherein said microprocessor means further functions to calculate a compensation variable (Bx) for use in calculating the compensation value.

4. The system according to claim 3, wherein the compensation value is calculated using the following relationship:

$$COBAT=(BATi-BATFI)\times(Bx)$$

where COBAT is the compensation value, BATi is the power signal, BATFi is the filtered power signal, and Bx is the compensation variable.

* * * * *